US010648233B2

(12) United States Patent
Moss et al.

(10) Patent No.: US 10,648,233 B2
(45) **Date of Patent: *May 12, 2020**

(54) ADJUSTABLE LADDERS AND RELATED METHODS

(71) Applicant: Wing Enterprises, Incorporated, Springville, UT (US)

(72) Inventors: N. Ryan Moss, Mapleton, UT (US); Gary M. Jonas, Springville, UT (US); Chad Grotegut, Orem, UT (US); Sean R. Peterson, Santaquin, UT (US); Brian B. Russell, Taylorsville, UT (US); Stephen E. Boynton, Spanish Fork, UT (US); Ryan Crawford, Spanish Fork, UT (US); Darius S. Penrod, Elberta, UT (US)

(73) Assignee: WING ENTERPRISES, INCORPORATED, Springville, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/284,801

(22) Filed: Feb. 25, 2019

(65) Prior Publication Data

US 2019/0186200 A1 Jun. 20, 2019

Related U.S. Application Data

(63) Continuation of application No. 14/624,360, filed on Feb. 17, 2015, now Pat. No. 10,214,961, which is a (Continued)

(51) Int. Cl.

| | |
|---|---|
| ***E06C 1/12*** | (2006.01) |
| ***E06C 7/00*** | (2006.01) |
| ***E06C 7/42*** | (2006.01) |

(52) U.S. Cl.
CPC ..... *E06C 1/12* (2013.01); *E06C 7/00* (2013.01); *E06C 7/003* (2013.01); *E06C 7/423* (2013.01); *Y10T 29/49826* (2015.01)

(58) Field of Classification Search
CPC ..... E06C 1/12; E06C 7/00; E06C 7/423
See application file for complete search history.

(56) References Cited

U.S. PATENT DOCUMENTS

| | | | |
|---|---|---|---|
| 105,123 | A | 7/1870 | Pullman |
| 546,379 | A | 9/1895 | Colton |

(Continued)

FOREIGN PATENT DOCUMENTS

| | | | |
|---|---|---|---|
| DE | 19802741 | A1 | 7/1999 |
| FR | 2701058 | A1 | 8/1994 |

(Continued)

OTHER PUBLICATIONS

International Search Report dated May 25, 2010 for International Patent Application No. PCT/US2010/026088.

*Primary Examiner* — Alvin C Chin-Shue
(74) *Attorney, Agent, or Firm* — Dorsey & Whitney LLP

(57) ABSTRACT

The present invention relates to ladders and, more particularly, various configurations of ladders including straight and extension ladders, as well as to methods relating to the use and manufacture of such ladders. In accordance with one embodiment of the present invention, a ladder is provided that includes a first pair of spaced apart rails and a plurality of rungs extending between and coupled to the first pair of spaced apart rails. The ladder also includes a pair of lateral support members, wherein each support member is selectively displaceable in a lateral direction relative to an associated rail. Additionally, the ladder includes a pair of adjustable legs, each leg having a first end slidably coupled to an associated rail of the first pair of spaced apart rails and (Continued)

being slidably coupled to an associated lateral support member.

8 Claims, 13 Drawing Sheets

Related U.S. Application Data continuation of application No. 13/733,733, filed on Jan. 3, 2013, now Pat. No. 8,973,710, which is a continuation of application No. 12/714,313, filed on Feb. 26, 2010, now Pat. No. 8,365,865.

(60) Provisional application No. 61/175,589, filed on May 5, 2009, provisional application No. 61/175,731, filed on May 5, 2009, provisional application No. 61/157,109, filed on Mar. 3, 2009.

(56) References Cited

U.S. PATENT DOCUMENTS

| | | | | | |
|---|---|---|---|---|---|
| 1,151,809 | A | | 8/1915 | Morgan | |
| 1,314,719 | A | | 9/1919 | Townsend | |
| 1,352,830 | A | * | 9/1920 | Obermeyer | E06C 1/20 182/171 |
| 1,385,319 | A | | 7/1921 | Enke | |
| 1,399,105 | A | | 12/1921 | Henry | |
| 2,185,782 | A | | 1/1940 | Brittin | |
| 2,767,898 | A | | 10/1956 | Cramer | |
| 2,885,133 | A | | 5/1959 | Nelson | |
| 3,025,926 | A | | 3/1962 | Vives | |
| 3,933,221 | A | | 1/1976 | Sorenson | |
| 4,011,926 | A | | 3/1977 | Larson et al. | |
| 4,147,231 | A | * | 4/1979 | Chantler | E06C 7/423 182/107 |
| 4,182,431 | A | | 1/1980 | Wing et al. | |
| 4,244,446 | A | | 1/1981 | Mair | |
| 4,519,477 | A | | 5/1985 | Ralston | |
| 4,569,419 | A | | 2/1986 | Stoltz | |
| 4,632,220 | A | | 12/1986 | Murrell | |
| 5,074,378 | A | | 12/1991 | Studer | |
| 5,082,088 | A | | 1/1992 | Krause | |
| 5,267,631 | A | | 12/1993 | Mendel | |
| 5,273,133 | A | | 12/1993 | Thocher et al. | |
| 5,370,203 | A | * | 12/1994 | Kiska | E06C 7/42 182/109 |
| 5,590,739 | A | | 1/1997 | High et al. | |
| 5,595,410 | A | | 1/1997 | Wilson et al. | |
| 5,845,744 | A | | 12/1998 | Beck et al. | |
| 6,336,521 | B1 | | 1/2002 | Dennis | |
| 6,347,777 | B1 | | 2/2002 | Webber et al. | |
| 6,959,785 | B1 | | 11/2005 | Chilton | |
| 7,093,690 | B2 | | 8/2006 | Swann | |
| 7,216,742 | B2 | | 5/2007 | Spengler | |
| 8,186,481 | B2 | | 5/2012 | Moss et al. | |
| 8,365,865 | B2 | | 2/2013 | Moss et al. | |
| 9,187,954 | B1 | | 11/2015 | Parsons | |
| 2008/0173852 | A1 | | 7/2008 | Woodbury et al. | |
| 2009/0107765 | A1 | | 4/2009 | Germond | |
| 2010/0038172 | A1 | * | 2/2010 | Ralston | E06C 7/18 182/107 |

FOREIGN PATENT DOCUMENTS

| | | | | |
|---|---|---|---|---|
| GB | 1524 | | | 1/1910 |
| GB | 238868 | A | | 2/1926 |
| GB | 586854 | A | | 4/1947 |
| GB | 2042041 | A | | 9/1980 |
| GB | 2372532 | A | | 8/2002 |
| GB | 2381554 | A | | 5/2003 |
| JP | 11193682 | A | * | 7/1999 |
| JP | 2004353266 | A | | 12/2004 |
| KR | 2020100008259 | | | 7/1999 |

* cited by examiner

ADJUSTABLE LADDERS AND RELATED METHODS

CROSS-REFERENCE TO RELATED APPLICATIONS

This application is a continuation of U.S. patent application Ser. No. 14/624,360 filed 17 Feb. 2015, now U.S. Pat. No. 10,214,961 entitled ADJUSTABLE LADDERS AND RELATED METHODS, which is a continuation of U.S. patent application Ser. No. 13/733,733 filed 3 Jan. 2013, now U.S. Pat. No. 8,973,710 entitled ADJUSTABLE LADDERS AND RELATED METHODS, which is a continuation of U.S. patent application Ser. No. 12/714,313 filed 26 Feb. 2010, now U.S. Pat. No. 8,365,865, entitled ADJUSTABLE LADDERS AND RELATED METHODS, which claims the benefit of U.S. Provisional Patent Application No. 61/157,109 filed 3 Mar. 2009, entitled ADJUSTABLE LADDERS AND RELATED METHODS, U.S. Provisional Patent Application No. 61/175,589 filed 5 May 2009, entitled ADJUSTABLE LADDERS AND RELATED METHODS, and U.S. Provisional Patent Application No. 61/175,731 filed 5 May 2009, entitled LADDERS, LADDER COMPONENTS, LADDER ACCESSORIES, LADDER SYSTEMS AND RELATED METHODS, the disclosures of each of which are incorporated by reference herein in their entireties.

TECHNICAL FIELD

The present invention relates generally to ladders and, more particularly, to ladders having components and features to provide selective adjustability as well as methods of making and using such ladders.

BACKGROUND

Ladders are conventionally utilized to provide a user thereof with improved access to elevated locations that might otherwise be inaccessible. Ladders come in many shapes and sizes, such as straight ladders, straight extension ladders, stepladders, and combination step and extension ladders. So-called combination ladders may incorporate, in a single ladder, many of the benefits of multiple ladderdesigns.

Ladders known as straight ladders or straight extension ladders are ladders that are conventionally positioned against an elevated surface, such as a wall or the edge of a roof, to support the ladder at a desired angle. A user then ascends the ladder to obtain access to an elevated area, such as access to an upper area of the wall or access to the roof. Straight ladders and straight extension ladders are referred to as being "straight" because their rails are typically straight and generally parallel to one another throughout the length of the ladder. A pair of feet or pads, one being coupled to the bottom of each rail, are conventionally used to engage the ground, a floor or some other supporting surface.

The rails of such ladders are conventionally spaced apart approximately 16 to 18 inches. In some applications, such as when the ladder is very tall, it may become desirable to have the feet spaced apart a greater distance to provide a widened footprint and improve stability. Such may also be the case in other types of ladders (e.g., combination ladders or step ladders). Additionally, oftentimes it is desired to use a ladder in a location where the ground or other supporting surface is not level. Positioning the ladder on such an uneven support surface, without taking further action, results in the ladder ascending at an undesirable lateral angle and likely makes use of the ladder unsafe.

There have been various efforts to remedy such issues with conventional ladders. For example, various embodiments of leg levelers—accessories that attach to the bottom portion of a ladder's rails—have been utilized to compensate for uneven surfaces by "extending" the length of the rail. Additionally, various embodiments of ladder stabilizers have been utilized wherein additional structural components are coupled to the ladder rails to alter the "footprint" of the ladder, typically making the footprint wider, in an effort to improve the stability to such ladders.

However, such efforts to provide additional stability to ladders have also had drawbacks. Often, leg levelers and stabilizers are provided as aftermarket items and are attached to the ladder by an end user. Such installation may not always be done with the appropriate care and attention. Additionally, such attachments or accessories are often intended to be removed after use meaning that they may be lacking in their structural integrity in their coupling with the ladder.

There is a continuing desire in the industry to provide improved functionality of ladders while maintaining or improving the safety and stability of such ladders. Thus, it would be advantageous to provide ladders with adjustable components that enable the ladder to be used on a variety of support surfaces while also perhaps providing enhanced stability. It would also be advantageous to provide methods related to the manufacture and use such ladders.

DISCLOSURE OF THE INVENTION

The present invention relates to ladders and, more particularly, various configurations of ladders, as well as to methods relating to the use and manufacture of ladders.

In accordance with one embodiment of the present invention, a ladder is provided that includes a first pair of spaced apart rails and a plurality of rungs extending between and coupled to the first pair of spaced apart rails. The ladder also includes a pair of lateral support members, each support member being selectively displaceable in a lateral direction relative to an associated rail. Additionally, the ladder includes a pair of adjustable legs, each leg having a first end slidably coupled to an associated rail of the first pair of spaced apart rails and being slidably coupled to an associated lateral support member.

In one embodiment, one or more locking mechanisms may be provided wherein the locking mechanism is configured to lock at least one of the pair of lateral support members at a desired lateral position relative to its associated rail. Additionally, at least one adjustment mechanism may be provided, wherein the adjustment mechanism is configured to maintain the first end of an associated adjustable leg at a desired position relative to its associated rail.

In accordance with another embodiment of the present invention, another ladder is provided that includes a pair of rails and a plurality of rungs coupled therebetween. The ladder further includes a pair of adjustable legs, each adjustable leg having a first end selectively positionable with respect to an associated rail, and a second end selectively positionable with respect to its associated rail independent of the location of the first end of the adjustable leg.

In accordance with another embodiment of the present invention, a foot for a ladder is provided. The foot includes a bracket for coupling with a leg of a ladder and a non-linear engagement surface configured to engage a supporting surface. In one embodiment, the non-linear engagement surface may further include a cushioned material such as a rubber or polymer material. In another embodiment, the foot may further include a plurality of spikes arranged in a non-linear pattern adjacent to the non-linear engagement surface. Each of the plurality of spikes may be located at a peripheral edge of the non-linear engagement surface.

In accordance with yet another embodiment of the invention a method is provided for adjusting a ladder having a first rail, a second rail and a plurality of rungs extending between the first and second rails. The method includes selectively displacing a first end of an adjustable leg that is slidingly coupled to the first rail and selectively displacing a second end of the adjustable leg relative to the first rail independent of the displacement of the first end of the adjustable leg.

In accordance with a further embodiment of the present invention, a method of manufacturing a ladder is provided. The method includes providing a pair of rails, coupling a plurality of rungs between the pair of rails, moveably coupling a lateral support member to a first rail of the pair of rails, slidably coupling an adjustable leg with the first rail, and slidably coupling the adjustable leg with the lateral support member.

BRIEF DESCRIPTION OF THE DRAWINGS

The foregoing and other advantages of the invention will become apparent upon reading the following detailed description and upon reference to the drawings in which.

BEST MODE(S) FOR CARRYING OUT THE INVENTION

Figure 1:
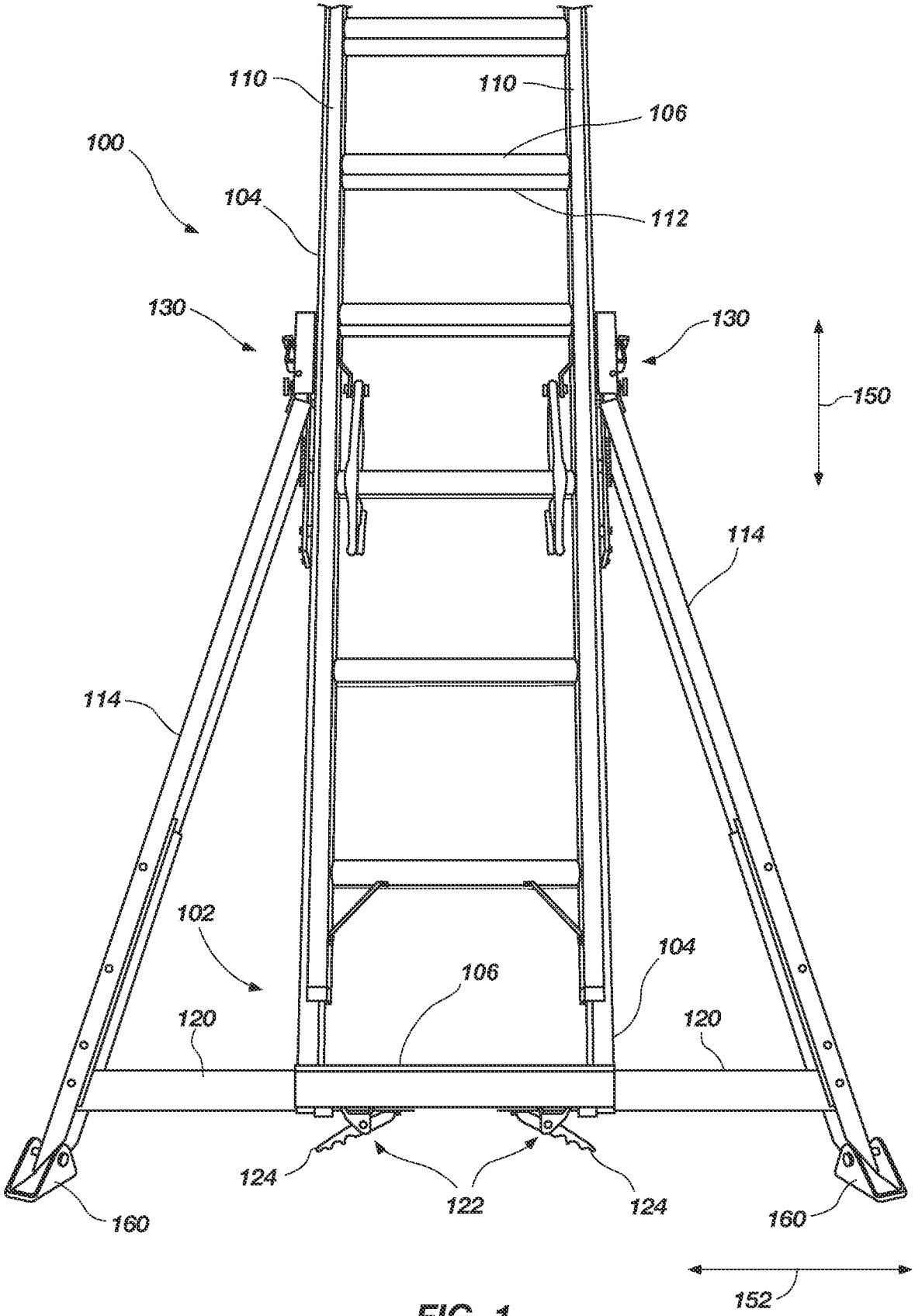
FIG. 1 is a front perspective view of a ladder according to an embodiment of the present invention.

Referring generally to FIGS. 1 through 6, a ladder 100 is shown in accordance with an embodiment of the present invention. The ladder 100 includes a first assembly 102 having a pair of spaced apart rails 104 and a plurality of rungs 106 extending between, and coupled to, the rails 104. The rungs 106 are substantially evenly spaced, substantially parallel to one another, and are configured to be substantially level when the ladder 100 is in an orientation of intended use, so that they may be used as "steps" for a user to ascend the ladder 100 as will be appreciated by those of ordinary skill in the art.

The ladder 100 shown in FIGS. 1 through 6 is configured as an extension ladder and also includes a second assembly 108 (see, e.g., FIG. 3) having a pair of spaced apart rails 110 and a plurality of rungs 112 extending between, and coupled to, the rails 110. The first assembly 102 and the second assembly 108 may be slidably coupled to one another such that the second assembly 108 may be selectively displaced relative to the first assembly 102 to effectively alter the height of the ladder 100. An adjustment mechanism 113 may be coupled with the second assembly 108 and interact with the first assembly 102 to enable the selective displacement between the two assemblies 102 and 108 and thereby alter the height of the ladder 100. The relationship and interaction of the first assembly 102, the second assembly 108 and the adjustment mechanism 113 in an extension ladder are known by those of ordinary skill in the art and need not be described in further detail herein. It is also noted that, while the embodiment described herein is shown and described as an extension ladder, the present invention embraces additional embodiments including, for example, straight ladders, step ladders and combination ladders.

The first and second assemblies 102 and 108 may be formed of a variety of materials and using a variety of manufacturing techniques. For example, in one embodiment, the rails 104 and 110 may be formed of a composite material, such as fiberglass, while the rungs and other structural components may be formed of aluminum or an aluminum alloy. In other embodiments, the assemblies 102 and 108 (and their various components) may be formed of other materials including other composites, plastics, polymers, metals and metal alloys.

An adjustable leg 114 is coupled to each rail 104 of the first assembly 102. The adjustable leg 114 is slidably coupled to its associated rail 104 and is also slidably coupled to an associated telescoping lateral support member 120. The lateral support members 120 are selectively positionable in a variety of lateral positions relative to the rails 104 of the first assembly 102. In one embodiment, the lateral support members 120 may extend within an interior portion of a rung 106 of the first assembly 102. The lateral support members 120 may be positioned adjacent one another such that they slide past one another when displaced to a selected position. In another embodiment, one lateral support member 120 may be positioned within an interior portion of the other lateral support member 120 in a telescoping relationship such that one slides within the other when displaced to a selected position.

A locking mechanism 122 may be associated with each lateral support member 120. For example, a locking mechanism may include a lever 124 having a pin or engagement member (not shown) that engages aligned holes or apertures in both the rung 106 and the lateral support member 120 extending therethrough. In one embodiment, the lever 124 may be biased so as to maintain engagement of the pin with the aligned holes. The locking mechanism 122 may be used to enable selective positioning of the lateral support member 120 at a variety of lateral positions and maintain the lateral support member 120 at a desired position. As discussed in further detail below, other structures or mechanisms may be used for providing selective adjustment and locking of the lateral support 120 relative to the first assembly 102.

Figure 3:
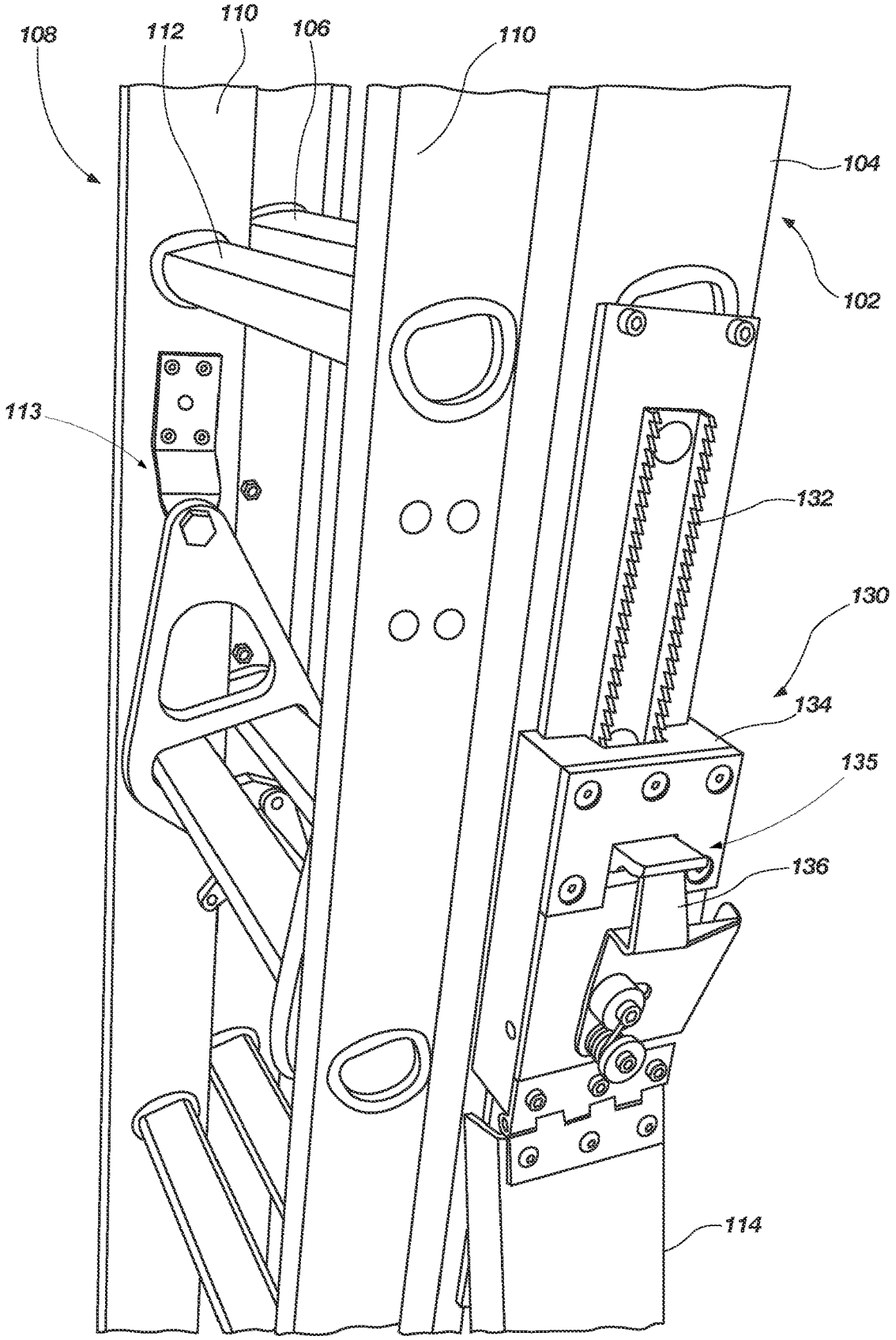
FIG. 3 is a perspective view from the front and side showing a portion of the ladder shown in FIG. 1 showing additional details of certain components.
Figure 4:
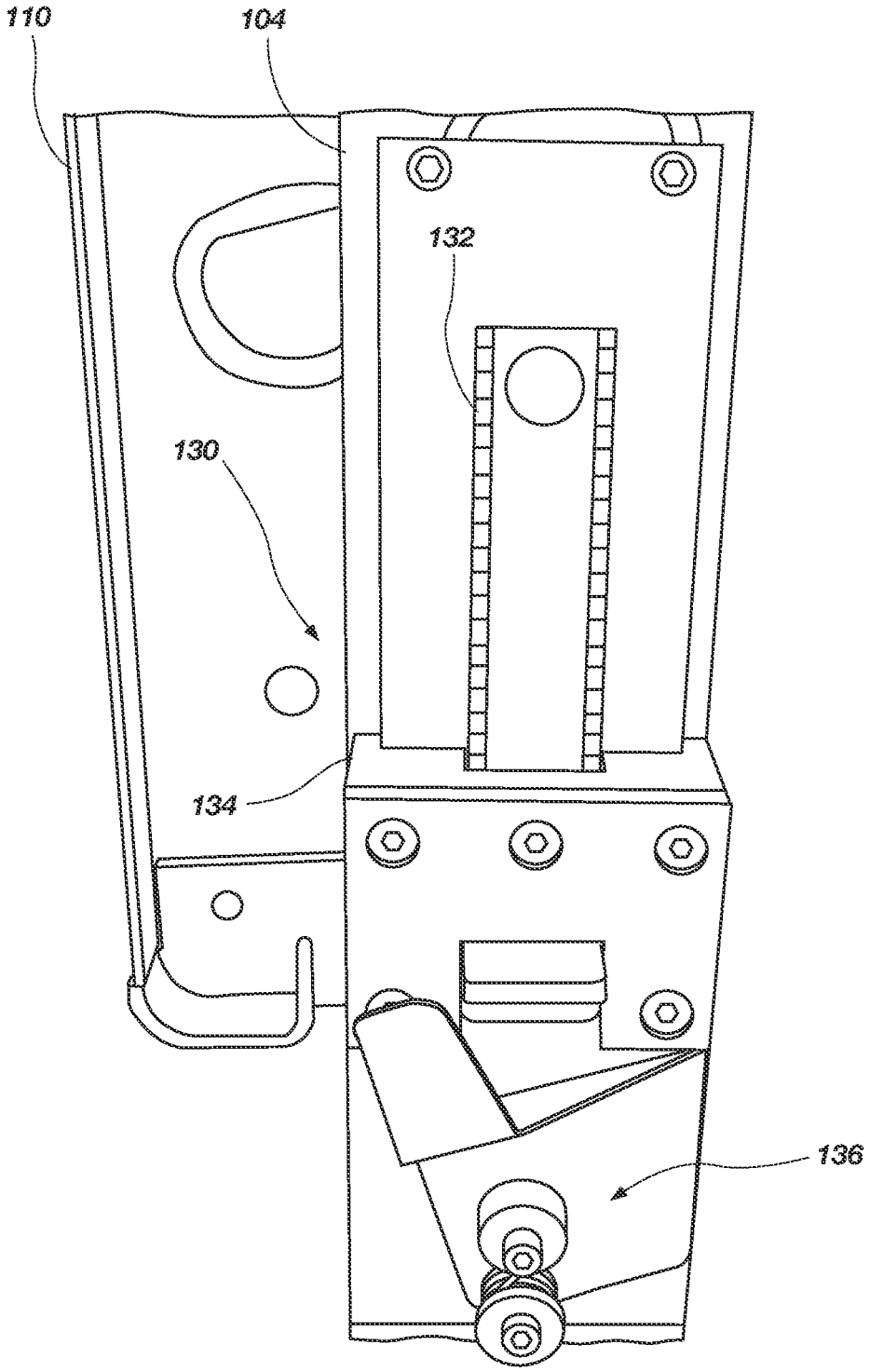
FIG. 4 is a side perspective view of a portion of the ladder shown in FIG. 1.

An adjustment mechanism 130 is also associated with each adjustable leg 114. In one embodiment, the adjustment mechanism 130 includes a geared rack 132 coupled with an associated rail 104 of the first assembly 102. A body, such as a block member 134 or other structural component, is slidably coupled with the rail 104 and may include, for example, a ratcheting mechanism 135 that engages the geared rack 132 and enables displacement of the block member 134 relative to the rail 104 in a first direction (i.e., downward when the ladder is in an orientation for intended use) while preventing displacement of the block member 134 in a second direction opposite that of the first direction (i.e., upward when the ladder is in an orientation of intended use). As seen in FIGS. 3 and 4, a lever 136 or other release member may be actuated to release the ratcheting mechanism 135 from the geared rack 132 to enable the block member 134 to slide in the second direction. In another embodiment, the adjustment mechanism 130 may be configured to limit movement in either direction when engaged.

It is noted that the locking mechanism 122 and the adjustment mechanism 130 are merely examples of potential mechanisms that may be used. In other embodiments, other appropriate adjustment and locking mechanisms may be utilized. Additionally, the locking mechanism 122 may be configured more similarly to the described adjustment mechanism 130 (with a gear and ratchet) or vice versa.

Figure 7A:
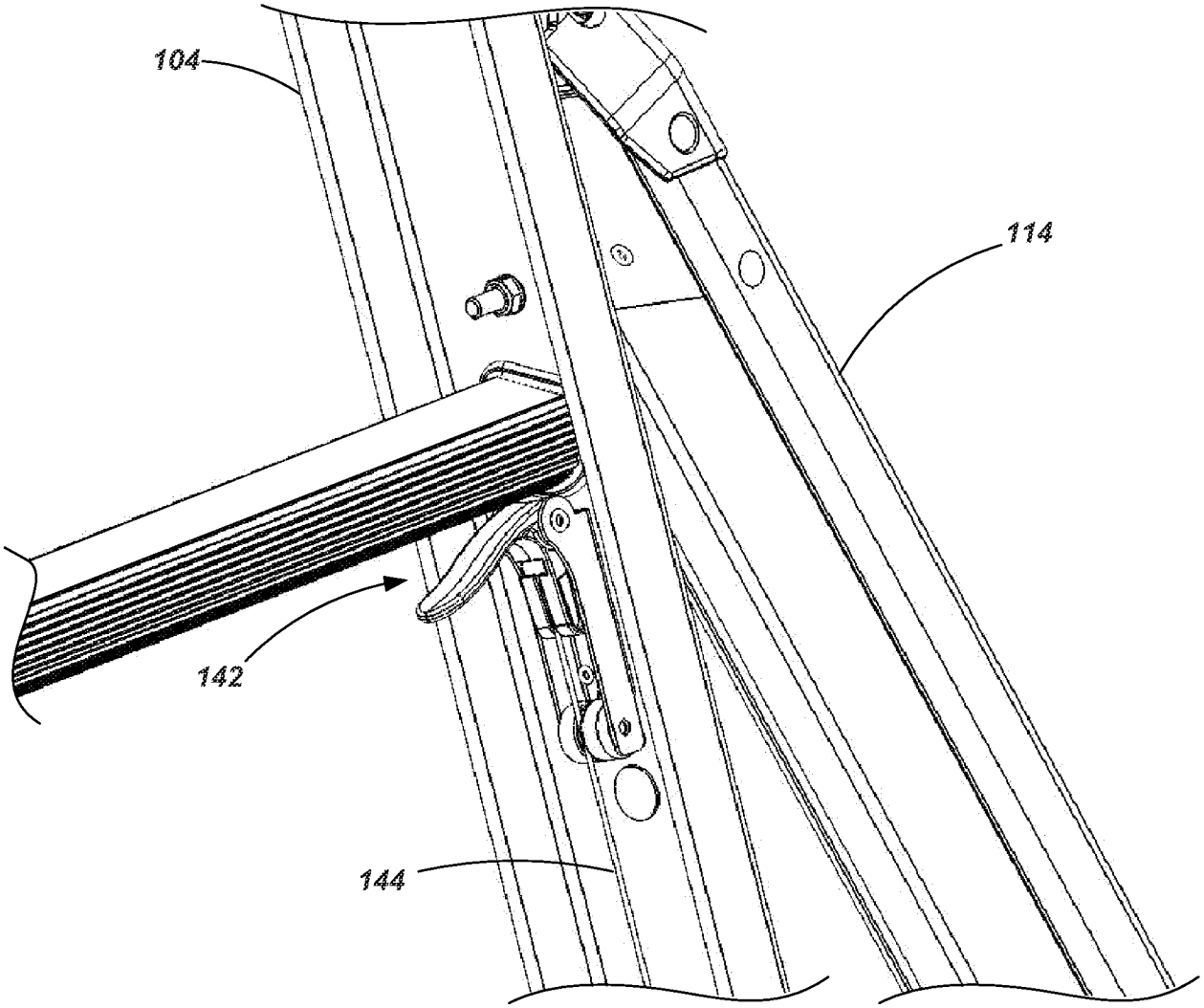
FIGS. 7A and 7B show portions of a ladder in accordance with another embodiment of the invention.
Figure 7B:
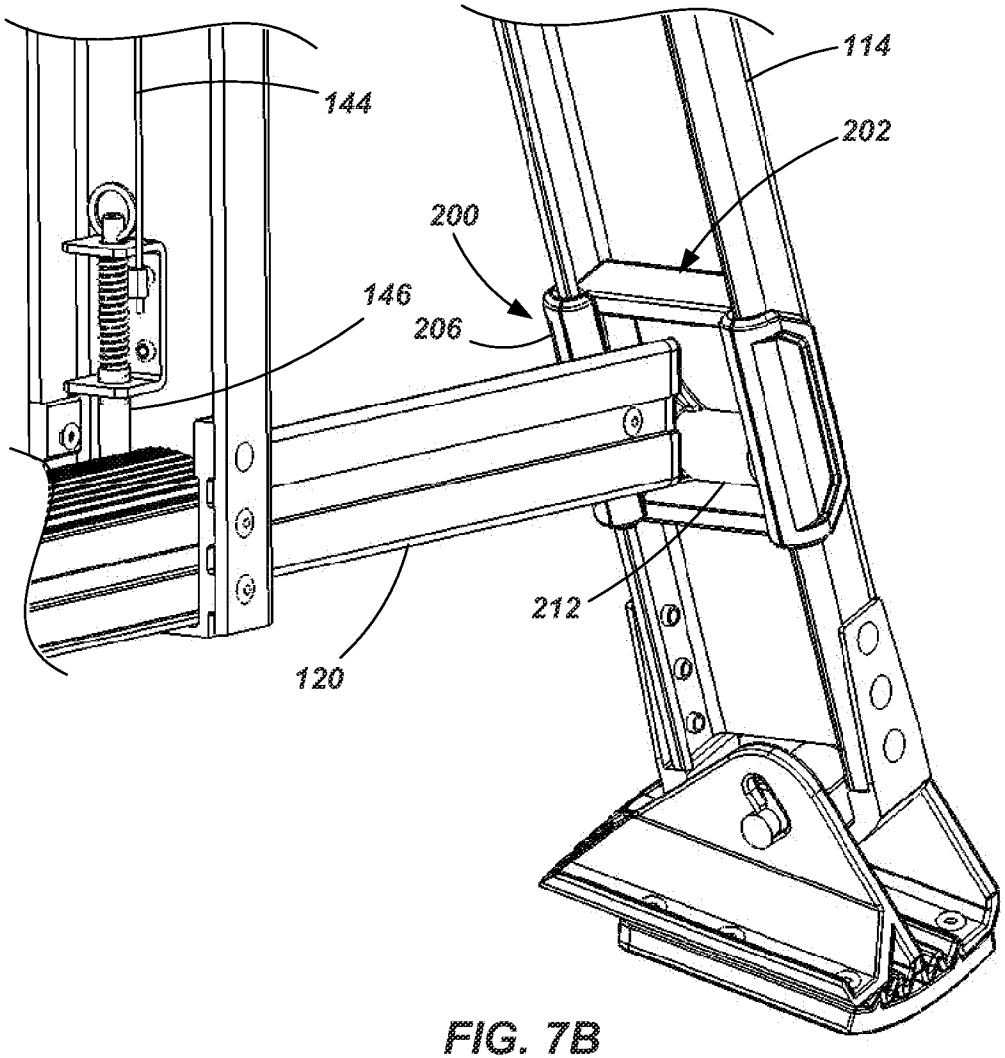

For example, referring to FIGS. 7A and 7B, in another embodiment, the locking mechanism 122 may be partially located inside the hollow of a side rail 104. For example, a lever assembly 142 may be coupled to the inside portion of a rail 104 and at a location just below a rung 106. The lever assembly 142 is coupled with a pull wire 144 that extends down along the interior surface of the rail 106. The pull wire 144 is coupled with a biased locking member, such as a pin 146, that engages the lower most rung 106 and the lateral support member 120 such as described above. The pin 146 is biased into a normally locked position and must have a force applied to it to overcome the biasing force of, for example, a spring 148 or other biasing element, and disengage the lateral support member 120. Thus, a user may actuate the lever assembly 142 which pulls the pin 146 upward via the pull wire 144 to disengage the lateral support member 120 for desired adjustment thereof. The specific rung 106 beneath which the lever assembly 142 is located may be determined by height at which the lever assembly is desired to be actuated. For example, the lever assembly 142 may be located such that a user may operate the actuating mechanism while standing (e.g., it may be located at an elevation that is approximately 3 to 5 feet about a supporting surface). Such a configuration provides increased ease of use by enabling a user to actuate the locking mechanism by hand while standing, and while "kicking" the associated leg 114 laterally outward or inward.

Figure 5:
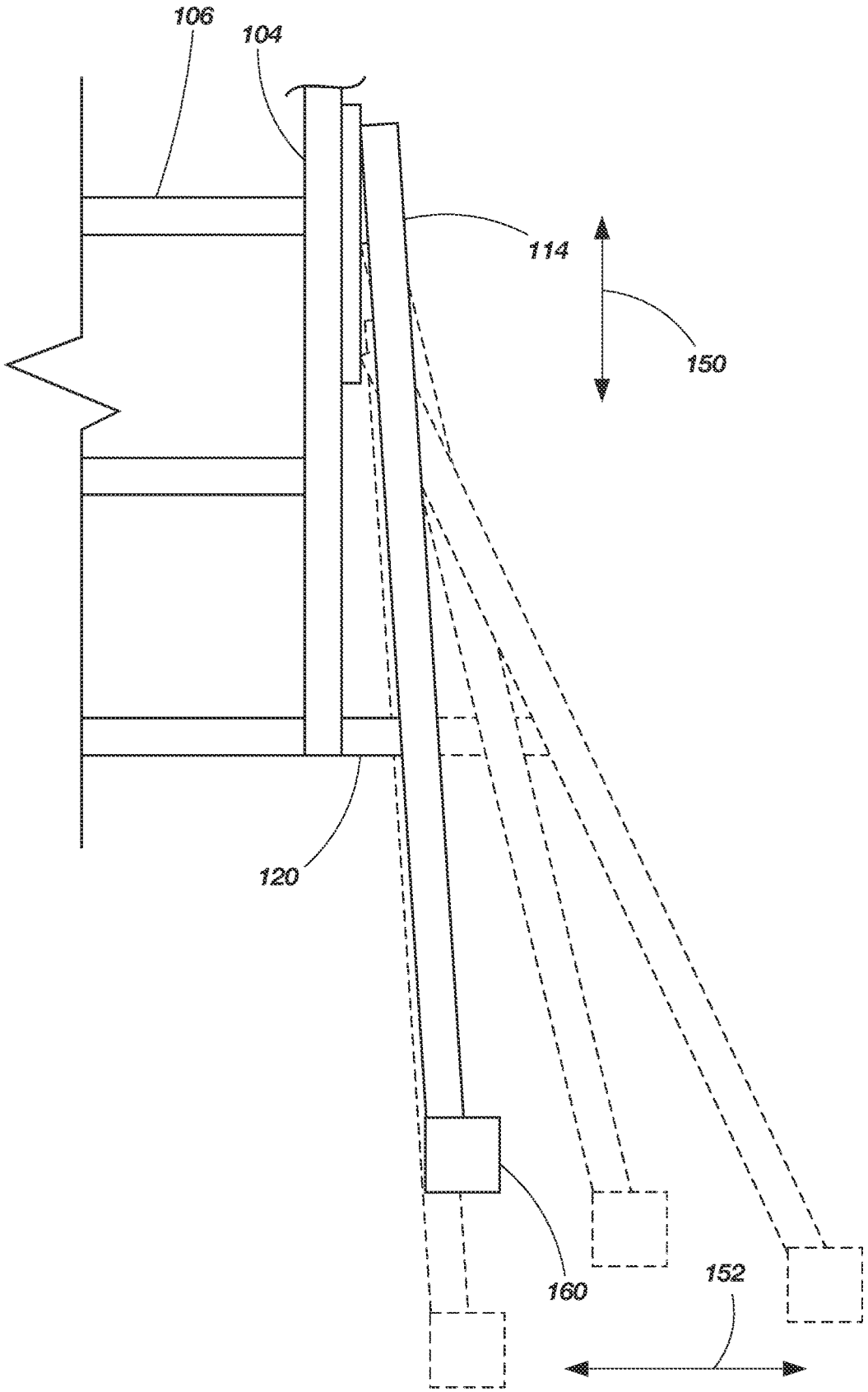
FIG. 5 is a front view of a portion of the ladder shown in FIG. 1 showing adjustability of certain components.
Figure 6:
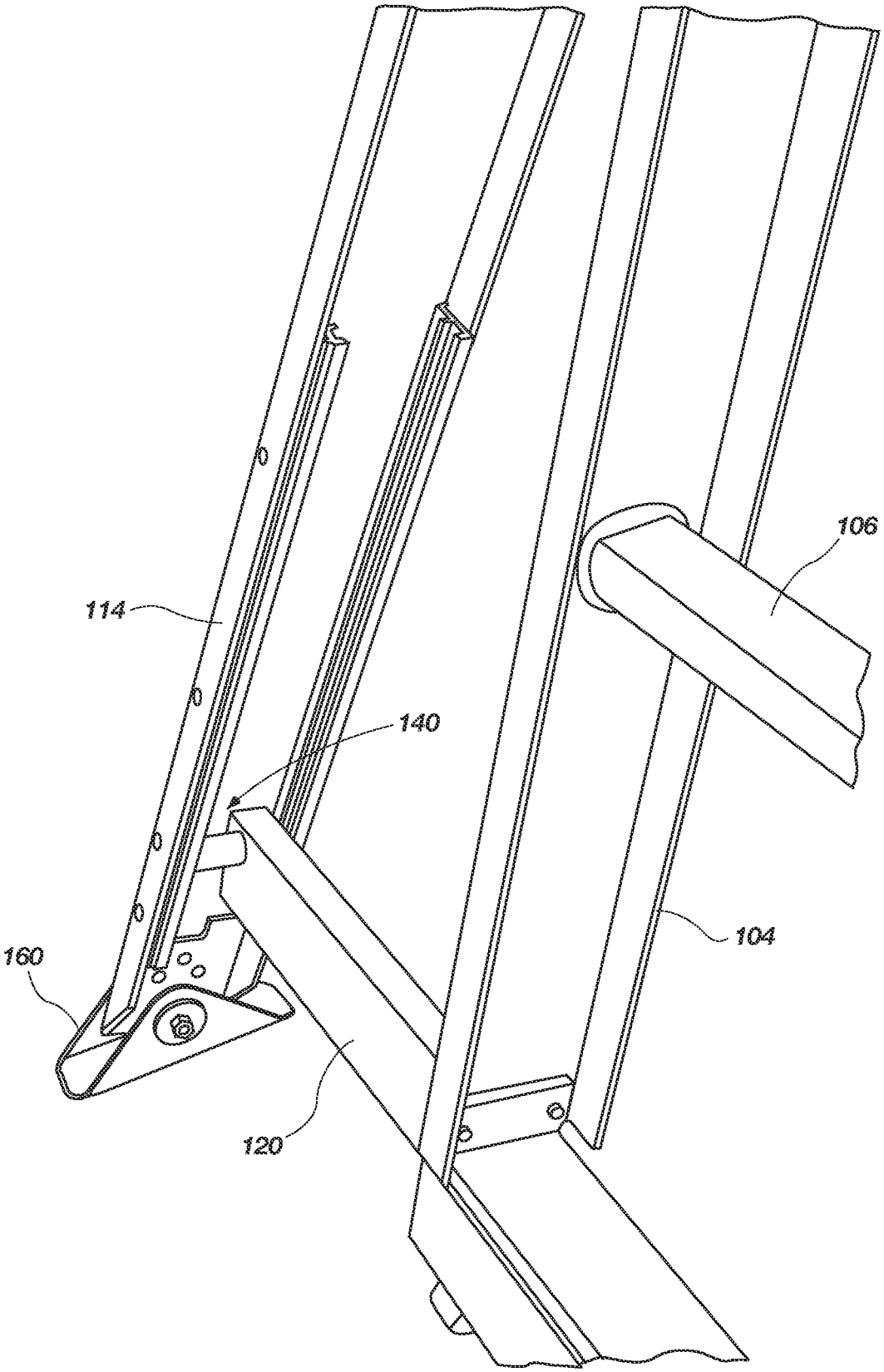
FIG. 6 is a perspective view of a portion of the ladder shown in FIG. 1 showing details of additional components.

Referring generally back to FIGS. 1 through 6, an upper end of the adjustable leg 114 may be hingedly coupled to the block member 134 such that the adjustable leg is displaceable with the block member 134 relative to the associated rail 104 and is also pivotal relative to the block member 134 (and, thus, relative to the rail 104). Additionally, as best seen in FIG. 6, the adjustable leg 114 is slidably coupled with the end of the associated lateral support member 120 such as by way of a linear bearing 140 or other appropriate structure or mechanism.

Figure 2:
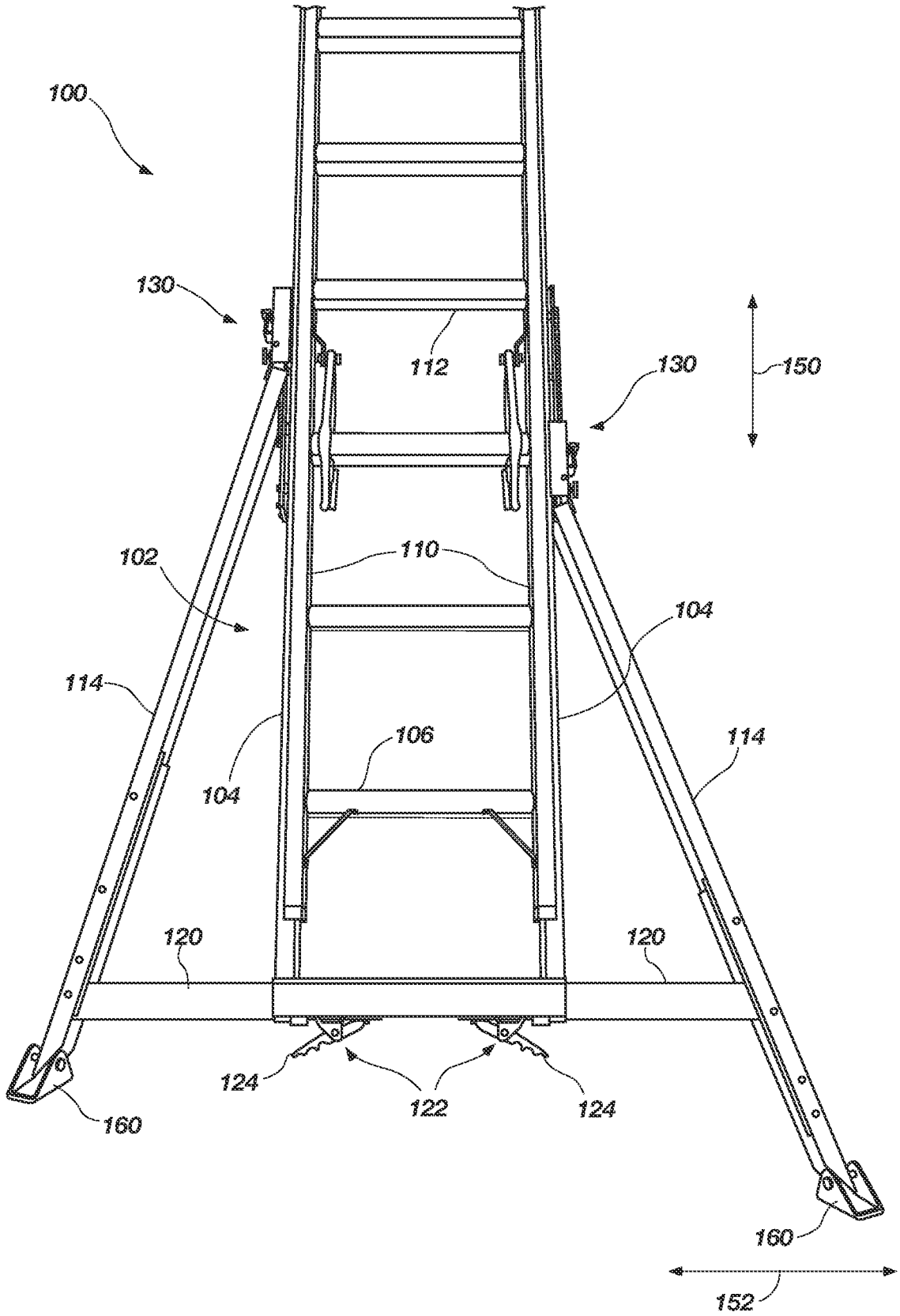
FIG. 2 is a front perspective view of the ladder shown in FIG. 1 after an adjustment to certain components of the ladder.

Thus, during use, and as seen more particularly in FIGS. 1, 2 and 5, each adjustable leg 114 is configured such that the lower end thereof (which may include an associated foot 160 as further described below) may be adjusted relative to its associated rail 104 in terms of both height (as indicated by arrow 150) and in terms of width (as indicated by arrow 152). Another way of describing the adjustment of the adjustable leg 114 is that the upper end thereof is configured for selective displacement in two linear directions (i.e., generally up and down when the ladder 100 is in an orientation of intended use such as shown in FIG. 1), while the lower end of the adjustable leg 114 is configured to be selectively displaced in a first set of linear directions (i.e., up and down) and a first set of angular directions resulting in the lower edge of the adjustable leg being selectively positioned to the left or the right when viewing the ladder in an orientation such as shown in FIG. 1.

The adjustability of each adjustable leg 114, independent of one another other, in terms of height adjustment, width adjustment, and angular adjustment enables the ladder 100 to be utilized in a variety of conditions, including on uneven ground, while providing enhanced stability as compared to numerous prior art ladders. Such adjustability may be seen by comparing the left hand adjustable leg 114 with the right hand adjustable leg 114 shown in FIG. 2, wherein the adjustable legs 114 are each at different elevations. FIG. 5 also shows, in dashed lines, some of the various potential positions of the adjustable leg 114 indicating the versatility of such a configuration.

As seen in FIGS. 1 through 6, a support structure such as a foot 160 may coupled with the lower end of each adjustable leg 114. For example, in one embodiment, a gimbaled connection or a multi-axis pivot, that enables the foot to adjust to the ground or other supporting surface about multiple axes. Such enables the foot to adjust while taking into account the angle of the adjustable leg 114 relative to the rail 104, as well as the angle that the ladder makes with the ground when it is positioned against an elevated supporting structure (e.g., a wall or the edge of a roof).

Figure 8B:
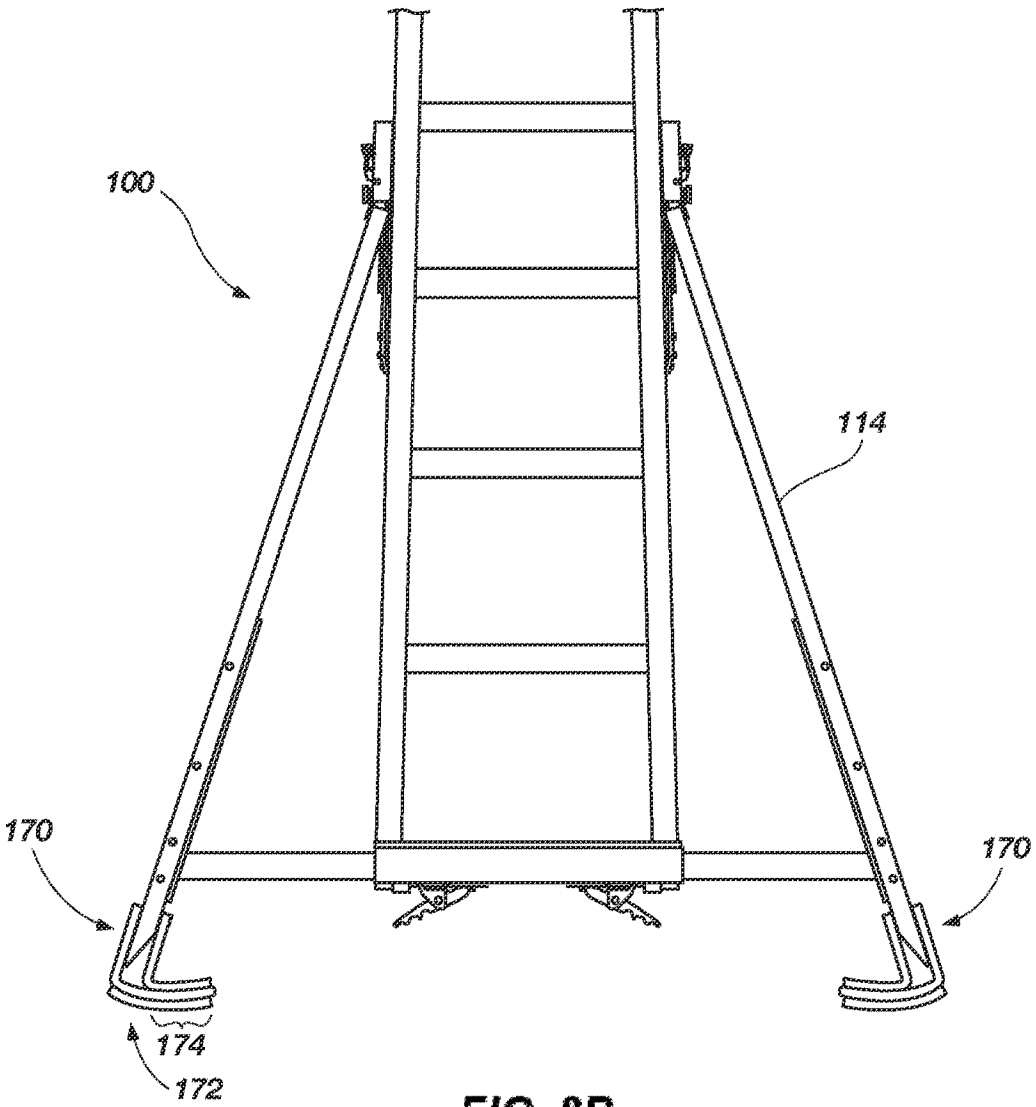
FIGS. 8A and 8B show a portion of a ladder including a ladder component in accordance with an embodiment of the present invention.
Figure 8A:
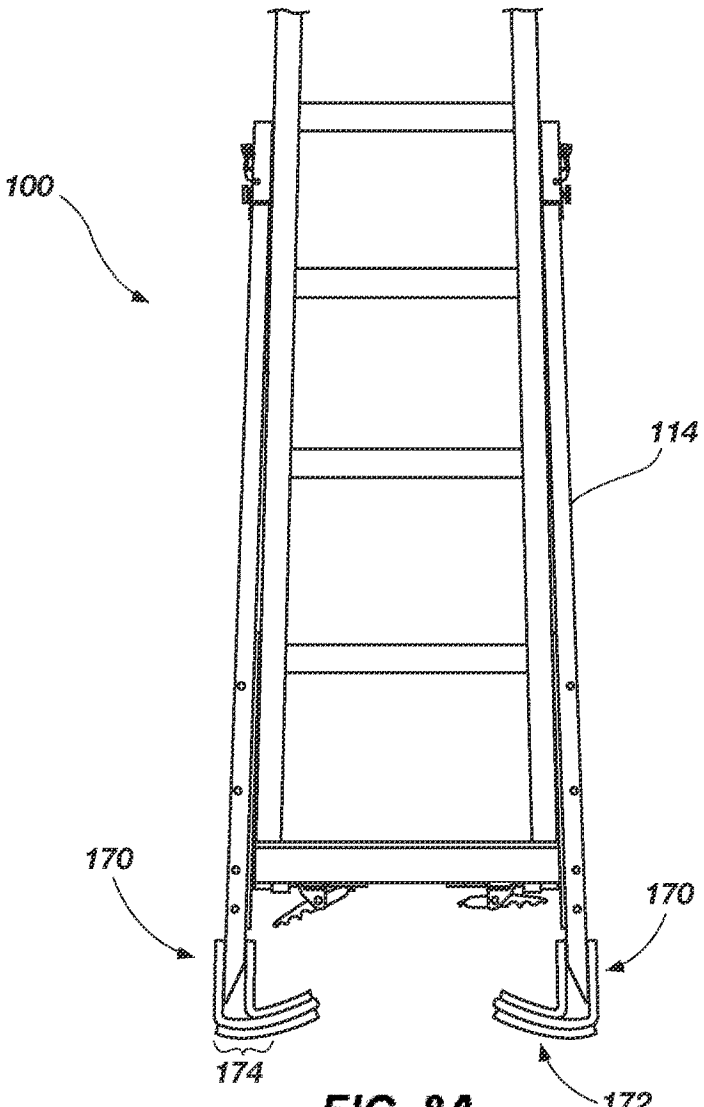

Referring briefly to FIGS. 8A, 8B, 9A and 9B, another embodiment of a foot 170 is shown. Each foot 170 includes a non-linear engagement surface 172 for engaging with the ground, a floor or some other supporting surface. The engagement surface 172 may include a cushioned pad, such as rubber, or may include a coating on a metal or metal alloy structure. As shown in FIGS. 8A and 8B, the non-linear engagement surface may include an arcuate or radiused surface (which may include a constant or a non-constant radius) configured such that, when the legs 114 are in a angular first position relative to their associated rails (e.g., as shown in FIG. 8A) a first portion 174 of the engagement surface 172 engages the ground, floor or other supporting surface. Additionally, when the legs 114 are in a second angular position relative to their associated rails 104, another portion 176 of the engagement surface 172 engages the ground, floor or other supporting surface. In one embodiment, the first portion 174 and the second portion 176 exhibit substantially similar surface areas. In another embodiment, the first portion 174 and the second portion 176 exhibit substantially similar lateral widths (i.e., taken in a direction extending substantially parallel to the rungs 106 and 112 of the ladder).

Figure 9B:
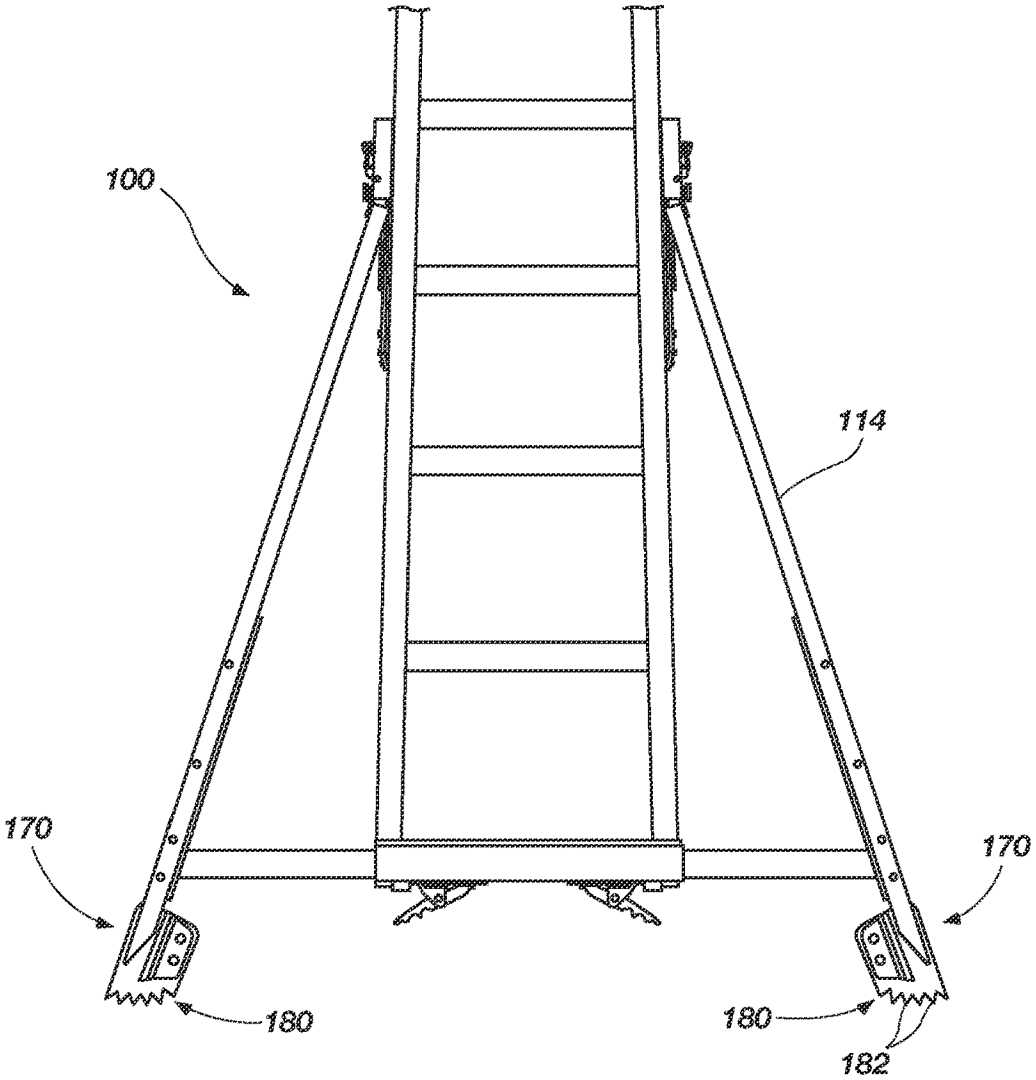
FIGS. 9A and 9B show the ladder and component of FIGS. 7A and 7B in another state or position.
Figure 9A:
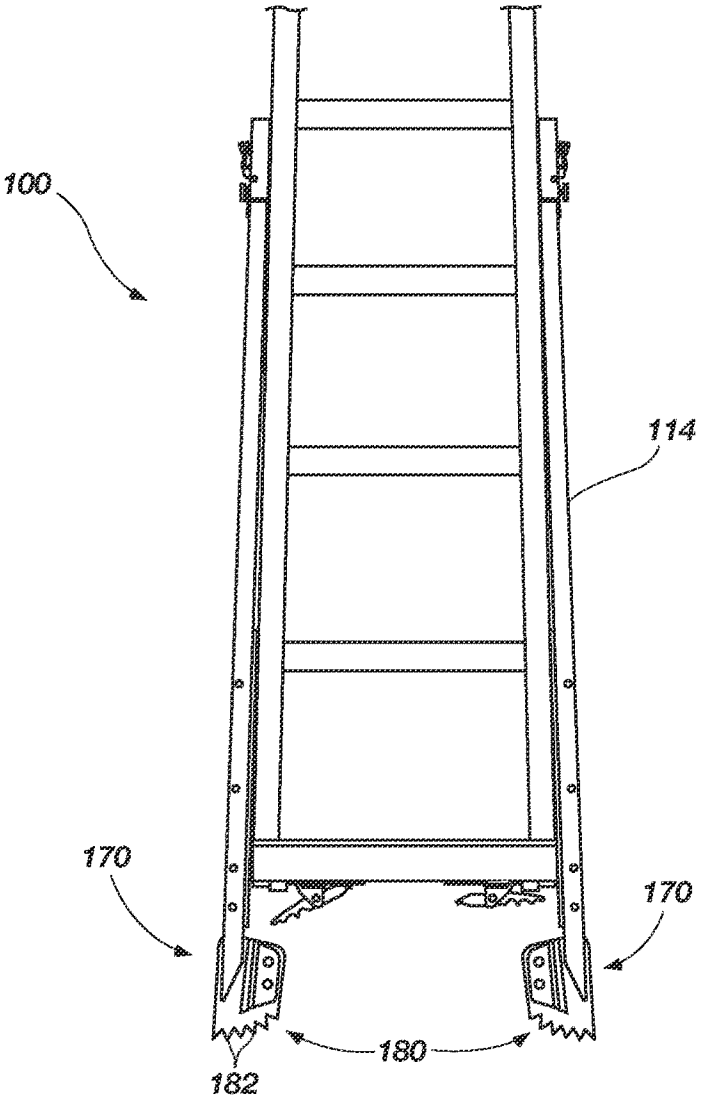

Each foot 170 is coupled to an associated leg 114 by a pivoting connection that enables the foot 170 to pivot between a first position relative to the legs 114 (i.e., as shown in FIGS. 8A and 8B) to a second position relative to the legs 114 (i.e., as shown in FIGS. 9A and 9B). A peripheral edge 180 of each foot may have one or more spikes or other engagement features formed thereon such that, when the feet 174 are in the position shown in FIGS. 8A and 8B, the spikes 182 may be used to engage the ground (e.g., dirt, lawn, etc.) and provide additional stability on such relatively soft surfaces. The spikes 182 are arranged in a non-linear pattern (i.e., a curve or other non-linear geometry may be drawn through the points of the plurality of spikes 182) such that the number of spikes oriented to engage the ground is substantially constant (e.g., within one or two) regardless of the angular position of the legs 114 as indicated by comparing FIGS. 9A and 9B.

Figure 10:
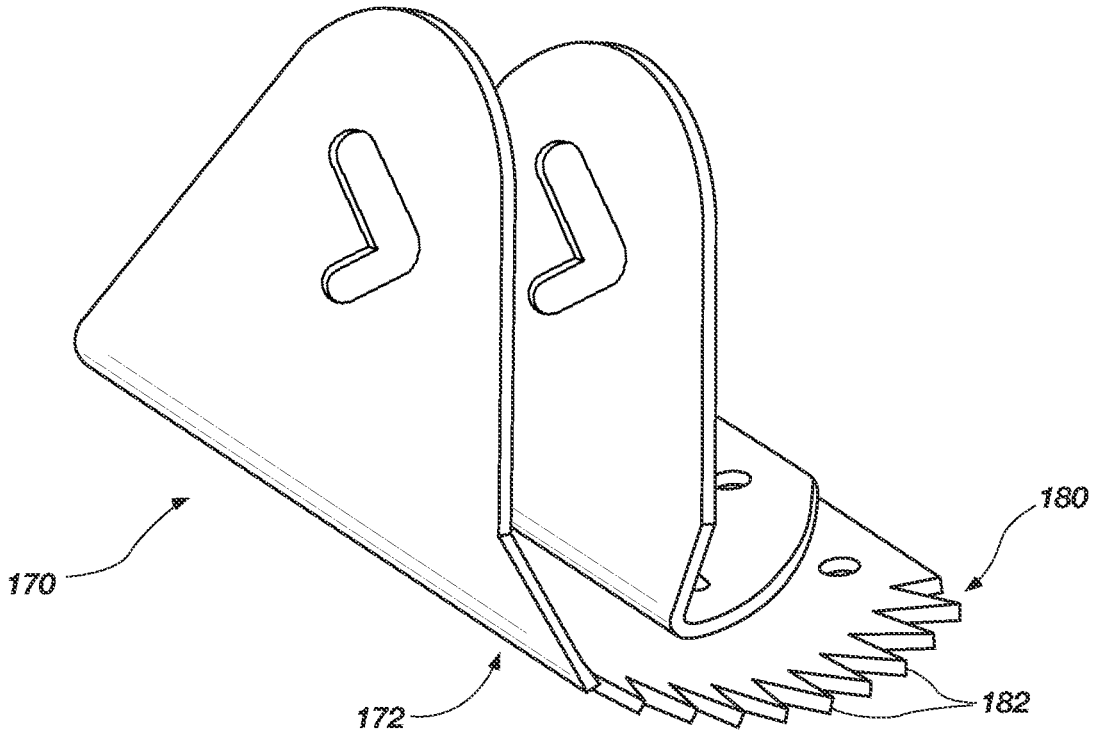
FIG. 10 is a perspective view of the component shown if FIGS. 7A-8B.

FIG. 10 is an enlarged view of such a foot 170 having a non-linear engagement surface 174 and a plurality of spikes 182 arranged in non-liner patterns. It is noted that FIG. 10 does not specifically show a cushioned pad 172. FIG. 10 also shows a pair of generally L-shaped or V-shaped slots through which a pin or other fastening member may pass in attaching the foot 170 to the adjustable legs 114 (see, e.g., FIG. 7B). The L-shaped configuration enables the foot 170 to pivot relative to the adjustable leg 114 for adjustment between the two positions described above (for example, compare FIG. 8A and FIG. 9A) while also enabling the foot 170 to be "locked" relative to the adjustable leg 114 when it is in one of its specified positions and with the weight of the ladder 100 resting on it.

Figure 11:
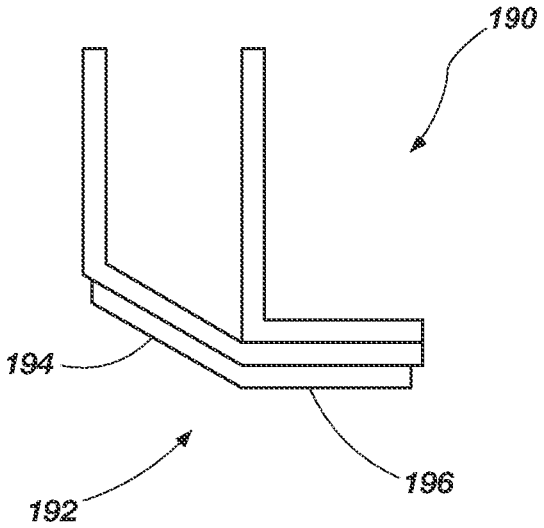
FIGS. 11 and 12 are additional embodiments of a ladder component.
Figure 12:
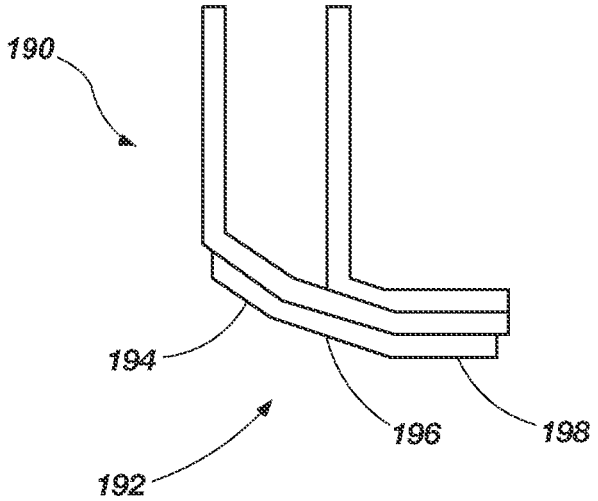

Referring briefly to FIGS. 11 and 12, additional embodiments of feet 190 are shown. The non-linear engagement surfaces 192 are shown as including a plurality of angularly disposed linear portions 194, 196 (and 198 in FIG. 12) adjacent one another. Each linear portion may correspond with an anticipated positioning of an associated leg 114 relative to a rail 104.

It is noted that, the presently described embodiment, the adjustable legs 114 and the feet 160 are the sole support of the ladder 100 on the ground or base surface. This is in contrast to numerous prior art configurations which employ angled support braces configured to augment primary feet or support structures of the ladder rather than act as the primary or sole support structures of the ladder. As such, the adjustable legs 114 are considered an integral and permanent part of the ladder 100 in the presently described embodiment. In other embodiments, such adjustment assemblies could be added to existing ladders even though such ladders already have dedicated feet acting as primary support structures.

Figure 13A:
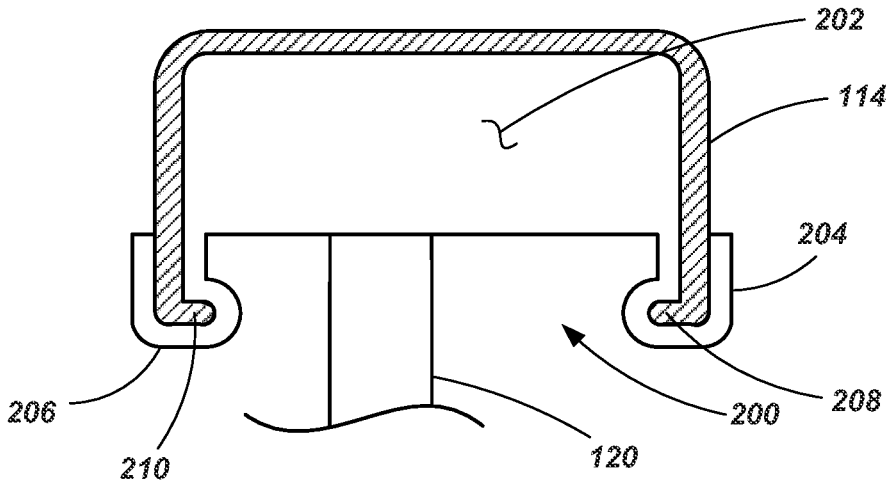
FIGS. 13A and 13B show an end view and a front view of a component that may be used with a ladder in accordance with an embodiment of the present invention.
Figure 13B:
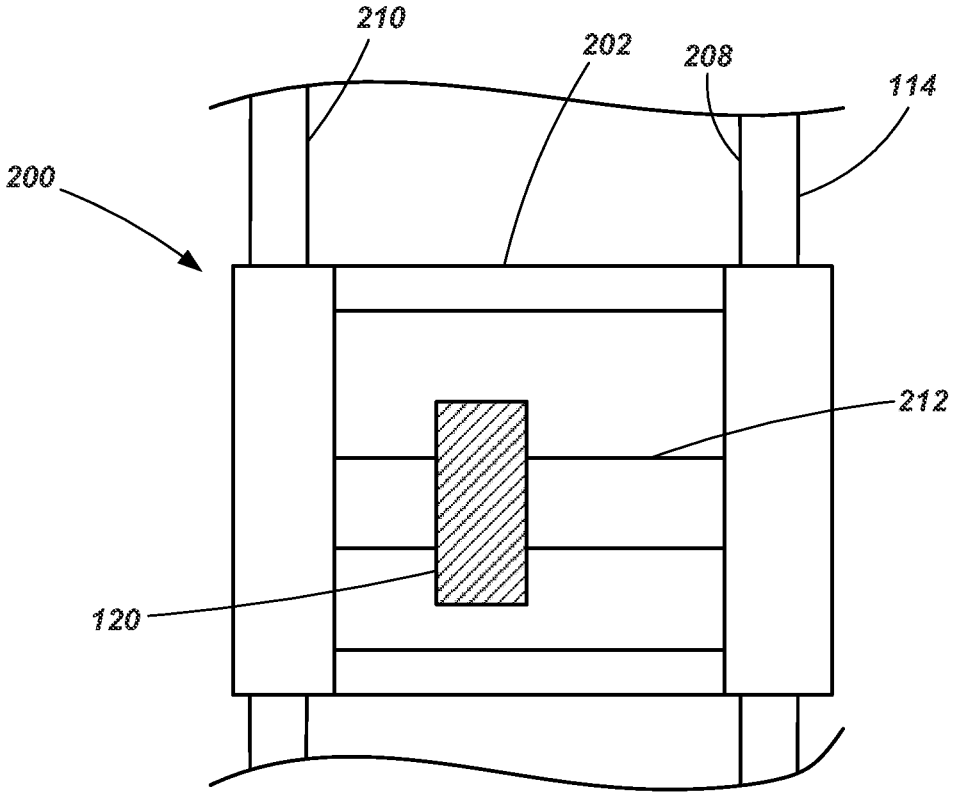

Referring briefly now to FIG. 7B in association with FIGS. 13A and 13B, a sliding bracket 200 is shown that may be used to couple a lateral support member 120 with an adjustable leg 114. The bracket 200 may include a body portion 202 sized, shaped and configured to be positioned within the interior of the channel formed by an adjustable leg 114. Flange portions 204 and 206 may be formed on each side of the body portion 202 to cooperatively or matingly engage the adjustable leg 114. Thus, for example, as shown in FIG. 13A, the adjustable leg 114 may exhibit a cross-sectional profile of a channel member having two lips 208 and 210 that return back towards each other. The flange portions 204 and 206 of the bracket 200 may be configured to mate with the lips 208 and 210 of the adjustable leg 114 such that the bracket 200 interlocks with the adjustable leg 114 in cross-sectional profile while also being able slide up and down the length of the adjustable leg 114. The bracket 200 is coupled to a pivot 212 associated with the lateral support member 120 such that, as the bracket 200 slides up and down the adjustable leg 114, or as the lateral support member 120 is displaced inwardly or outwardly relative to the rail 104, or as both occur, the bracket 200 can pivot relative to the lateral support member 120.

Besides accommodating the adjustment of the adjustable leg 114, the bracket 200 also provides reinforcement to the adjustable leg 114 at a location of applied force. In other words, a substantial portion of the weight of the ladder 100, a user standing thereon, and any tools or other materials they may be carrying, is ultimately transferred through the adjustable legs 114 and through its connections to the first assembly 102 (i.e., through its hinged connection at the upper end of the adjustable leg 114 and through its coupling with the lateral support member 120). This can create local points or regions of increased stress. Use of the bracket 200 assists in providing structural integrity to the adjustable leg 114 such that it doesn't fail by bending or twisting, for example.

Figure 14B:
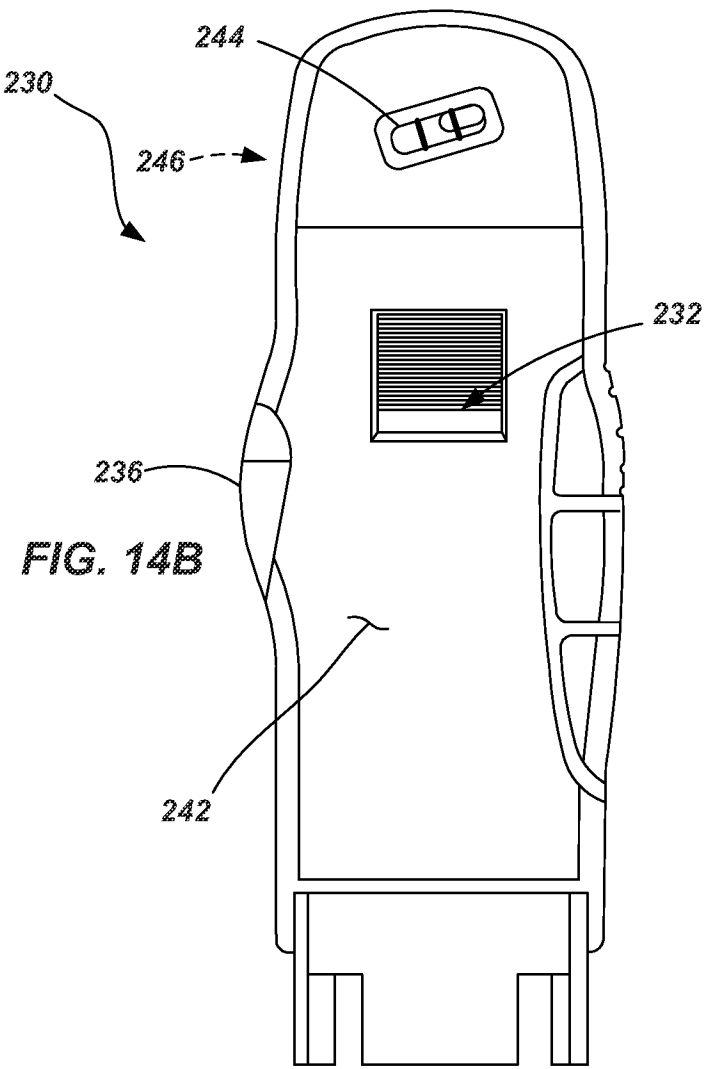
FIGS. 14A and 14B show back and front views of a mechanism that may be used in accordance with an embodiment of the present invention.
Figure 14A:
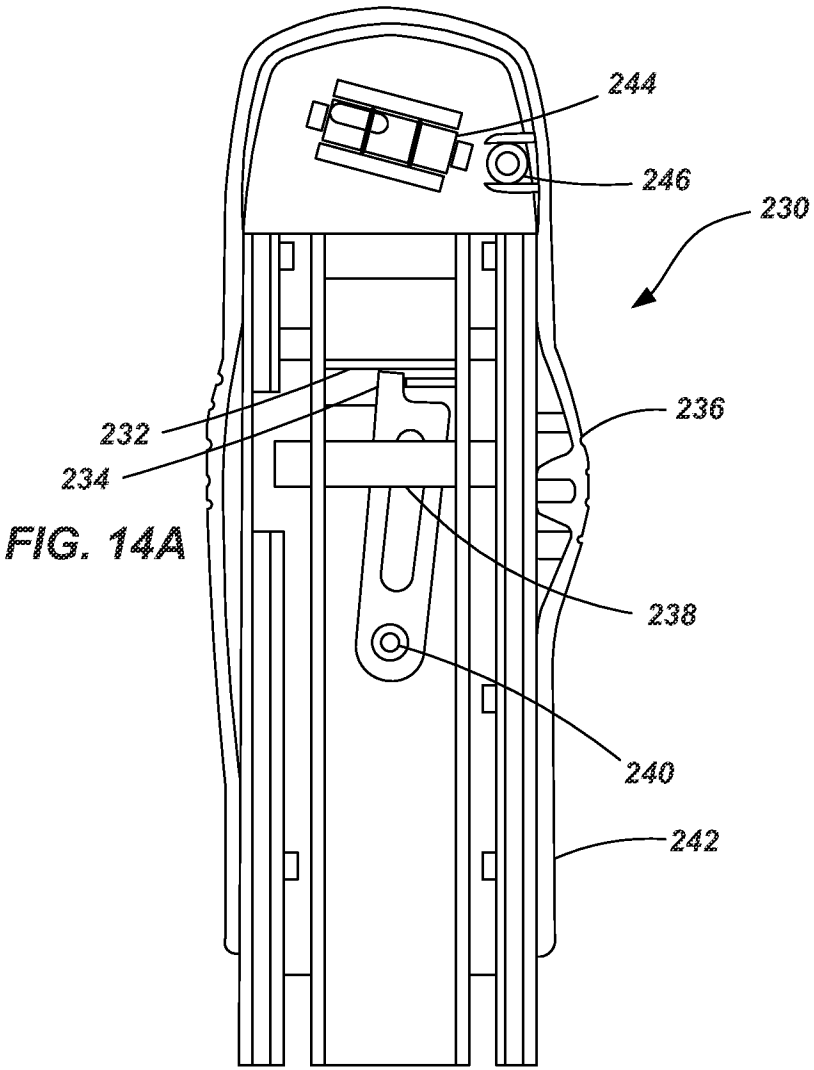

Referring now to FIGS. 14A and 14B, an adjustment mechanism 230 is shown in accordance with another embodiment of the present invention. The adjustment mechanism 230 is configured to be slidingly coupled with a rail 104 of a ladder 100 and engage with a toothed rack 132 such as described above with respect to FIGS. 3 and 4. The mechanism 230 includes a ratcheting mechanism, such as described above, having a rack engaging member 232 to selectively engage the teeth of the mechanism with the rack 132. A safety lever 234 or other structure engages the rack engaging member 232 to prevent the rack engaging member 232 from being inadvertently actuated when bumped by a user or some external structure or component. A button 236 is configured to be actuated by a used and is pressed by hand (e.g., by a user's thumb) to displace the button laterally 236 inwardly. Displacement of the button 236 results in concurrent displacement of a pin 238 that is coupled with the safety lever 234 causing the safety lever to pivot about a pin 240 or other fastener. When the safety lever 234 is rotated due to displacement of the button 236 and pin 238, it moves clear of the rack engaging member 232 such that the rack engaging member 232 may be actuated by a user. Actuation of the rack engaging member 232 results in disengagement with the toothed rack 132 so that the adjustment mechanism 230 may be slid up or down an associated rail 104 (see FIGS. 1 through 6) for selective positioning of an adjustment leg 114.

The adjustment mechanism 230 may also include additional features. For example, a shroud or housing element 242 may be placed over the various components for aesthetics and for safety in preventing pinching of a users hand or fingers during operation of the adjustment mechanism. Additionally, one or more levels or position indicators 244 and 246 may be associated with the adjustment mechanism 230 or otherwise coupled with some other portion of the ladder 100. For example, a first position indicator 244 may include a bubble or "spirit" level that indicates when the ladder 100 is at a safe climbing angle when being positioned up against a wall or other elevated structure. Additionally, another position indicator 246 may include a bubble level or a weighted indicator to help identify if the rungs 106 and 112 (as they extend between associated spaced apart rails 104 and 110, respectively) are level relative to the ground. While not specifically shown in FIGS. 14A and 14B, the position indicator 246, or at least a portion thereof, may be visible through an opening in the housing 242 (e.g., through the side of the housing). Such features provide safety checks for a user in setting up the ladder prior to the user actually ascending the ladder.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A ladder comprising:

a first pair of spaced apart rails including a first rail and a second rail;

a plurality of rungs extending between and coupled to the first rail and the second rail;

a first adjustable leg having a first end pivotally coupled with a first longitudinal locking mechanism, the first longitudinal locking mechanism being slidably coupled with the first rail and configured for selective positioning at a plurality of longitudinal positions along a length of the first rail, the first adjustable leg being pivotally positionable relative to the first rail between a first position, wherein the first adjustable leg is collapsed against, and extends substantially parallel with, the first rail, and at least a second position wherein a second end of the first adjustable leg is spaced laterally away from the first rail such that the second adjustable leg extends at an acute angle relative to the second rail;

a first discrete lateral support extending between the first rail and the first adjustable leg, the first discrete lateral support having one end pivotally attached to the first adjustable leg, the first discrete lateral support being substantially concealed within a portion of the ladder when the first adjustable leg is in the first position;

a second adjustable leg having a first end pivotally coupled with a second longitudinal locking mechanism, the second longitudinal locking mechanism being slidably coupled with the second rail and configured for selective positioning at a plurality of longitudinal positions along the second rail, the second adjustable leg being pivotally positionable relative to the second rail between a first position, wherein the second adjustable leg is collapsed against, and extends substantially parallel with, the second rail, and at least a second position wherein a second end of the second adjustable leg is spaced laterally away from the first rail such that the second adjustable leg extends at an acute angle relative to the second rail;

a second discrete lateral support extending between the second rail and the second adjustable leg;

a first bracket coupled with the first adjustable leg and pivotally coupled with a first end of the first lateral support, the first bracket including body portion positioned within an interior channel portion of the first adjustable leg; and a second bracket coupled with the second adjustable leg and pivotally coupled with a first end of the second lateral support, the second bracket including a body portion positioned within an interior channel portion of the second adjustable leg;

wherein the first adjustable leg is moveable between its first and second positions independent of whether the second adjustable leg is in the first position or the second position.

2. The ladder of claim 1, wherein the second discrete lateral support includes one end pivotally attached to the second adjustable leg, and wherein the second discrete lateral support is substantially concealed within another portion of the ladder when the second adjustable leg is in the first position.

3. The ladder of claim 1, wherein:

the second end of the first adjustable leg is continually positioned lower than a lowermost end of the first rail when the ladder is in an orientation of intended use and as the first adjustable leg transitions from the first adjustable leg's first position to the second position; and wherein the second end of the second adjustable leg is continually positioned lower than a lowermost end of the second rail when the ladder is in an orientation of intended use and as the second adjustable leg transitions from the first adjustable leg's first position to the second position.

4. The ladder of claim 1, further comprising:

a second pair of rails; and another plurality of rungs extending between and coupled to the second pair of spaced apart rails;

wherein the second pair of rails are slidably coupled with the first pair of rails.

5. The ladder of claim 1, further comprising a first foot coupled with the first adjustable leg, and a second foot coupled with the second adjustable leg, wherein each foot comprises a coupling bracket configured to enable the foot to pivot between a first foot position and a second foot position.

6. The ladder of claim 5, wherein each foot includes a first nonlinear engagement surface comprising a cushioned material, and a second nonlinear engagement surface including a plurality of spikes arranged in a non-linear pattern along a peripheral edge of the foot.

7. The ladder of claim 1, wherein the longitudinal position of the first locking mechanism is independent of whether the first adjustable leg is in its first position or its second position.

8. The ladder of claim 7, wherein the longitudinal position of the second locking mechanism is independent of whether the second adjustable leg is in its first position or its second position.

* * * * *